US011077666B2

(12) United States Patent
Tokunaga et al.

(10) Patent No.: US 11,077,666 B2
(45) Date of Patent: Aug. 3, 2021

(54) WASTE LIQUID COLLECTOR AND LIQUID DISCHARGE APPARATUS

(71) Applicants: Yusuke Tokunaga, Kanagawa (JP); Daisuke Nakamura, Kanagawa (JP)

(72) Inventors: Yusuke Tokunaga, Kanagawa (JP); Daisuke Nakamura, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 126 days.

(21) Appl. No.: 16/585,312

(22) Filed: Sep. 27, 2019

(65) Prior Publication Data

US 2020/0101745 A1 Apr. 2, 2020

(30) Foreign Application Priority Data

Sep. 27, 2018 (JP) ..... JP2018-182297

(51) Int. Cl.
*B41J 2/17* (2006.01)
*B41J 29/13* (2006.01)

(52) U.S. Cl.
CPC ..... *B41J 2/1721* (2013.01); *B41J 29/13* (2013.01); *B41J 2002/1728* (2013.01)

(58) Field of Classification Search
CPC ..... B41J 2/1721; B41J 29/13
See application file for complete search history.

(56) References Cited

U.S. PATENT DOCUMENTS

| | | | |
|---|---|---|---|
| 2008/0291240 A1 | 11/2008 | Ohsako et al. | |
| 2011/0141209 A1 | 6/2011 | Tsukamura et al. | |
| 2013/0155158 A1 | 6/2013 | Tsukamura et al. | |
| 2017/0266968 A1* | 9/2017 | Ishibe | B41J 2/17509 |

FOREIGN PATENT DOCUMENTS

| | | |
|---|---|---|
| JP | 2000-127453 | 5/2000 |
| JP | 2011-088424 | 5/2011 |
| JP | 2013-067123 | 4/2013 |

* cited by examiner

*Primary Examiner* — Lamson D Nguyen
(74) *Attorney, Agent, or Firm* — Xsensus LLP

(57) ABSTRACT

A waste liquid collector includes a waste liquid tank, a rotatable member, and a cover. The waste liquid tank is removably inserted in the waste liquid collector, the waste liquid tank configured to collect waste liquid. The rotatable member is configured to rotate with removal or insertion of the waste liquid tank. The cover is configured to contact a waste liquid inlet portion of the waste liquid tank to cover a waste liquid inlet portion, the cover being slidable with respect to the rotatable member.

7 Claims, 12 Drawing Sheets

WASTE LIQUID COLLECTOR AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2018-182297, filed on Sep. 27, 2018, in the Japan Patent Office, the entire disclosure of which is incorporated by reference herein.

BACKGROUND

Technical Field

Aspects of the present disclosure relate to a waste liquid collector and a liquid discharge apparatus.

Related Art

For example, a printing apparatus serving as a liquid discharge apparatus performs dummy discharge (including flushing and purging) to discharge liquid noncontributory to printing, as maintenance of a liquid discharge head, and produces waste liquid.

Conventionally, there has been disclosed an apparatus including a waste liquid tank removably inserted into a body of the apparatus and a seal member provided at a portion that couples with a waste liquid outlet of the waste liquid tank.

SUMMARY

In an aspect of the present disclosure, there is provided a waste liquid collector includes a waste liquid tank, a rotatable member, and a cover. The waste liquid tank is removably inserted in the waste liquid collector, the waste liquid tank configured to collect waste liquid. The rotatable member is configured to rotate with removal or insertion of the waste liquid tank. The cover is configured to contact a waste liquid inlet portion of the waste liquid tank to cover a waste liquid inlet portion, the cover being slidable with respect to the rotatable member.

In another aspect of the present disclosure, there is provided a liquid discharge apparatus including the waste liquid collector.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
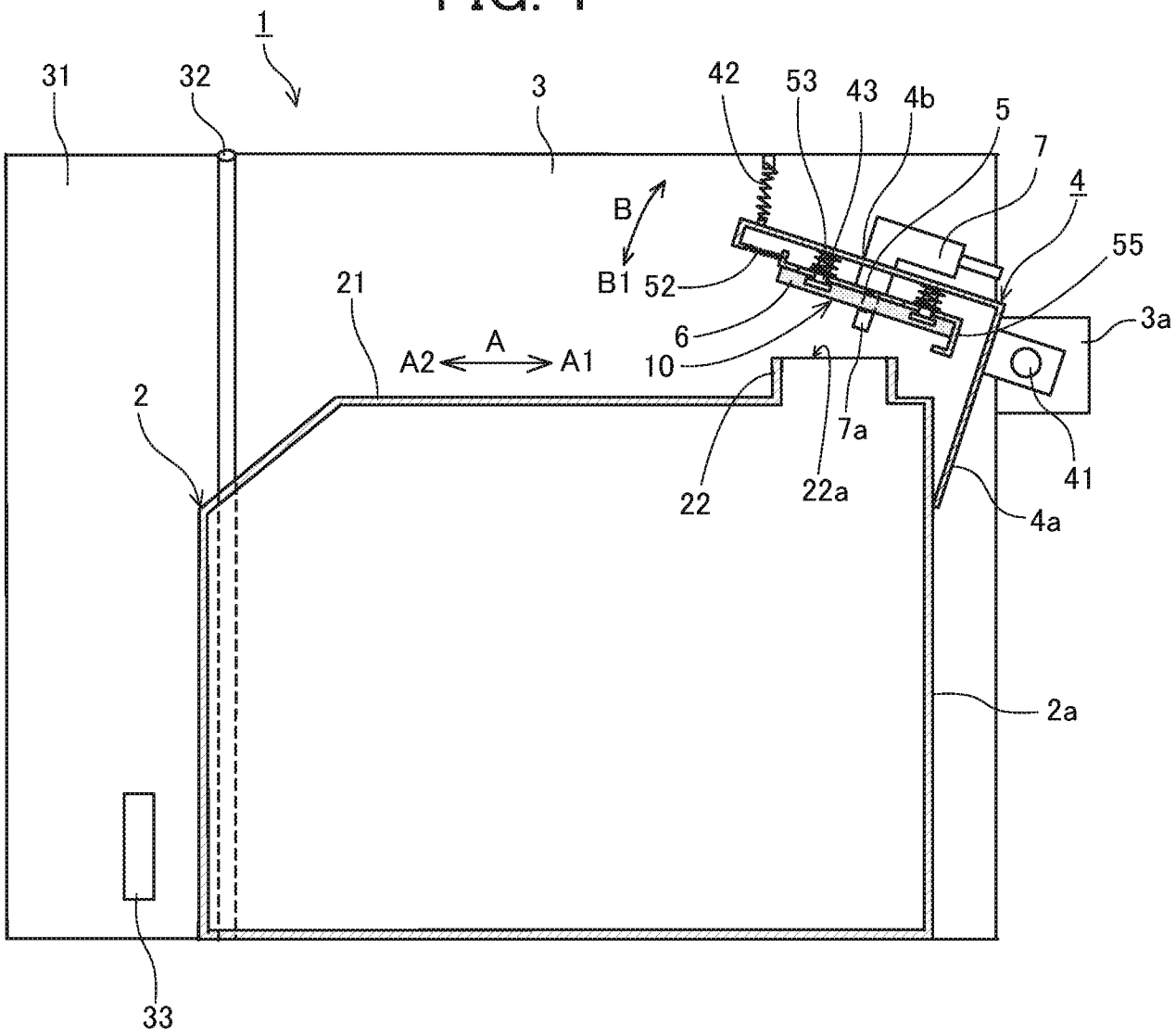
FIG. 1 is a side view of a waste liquid collector according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
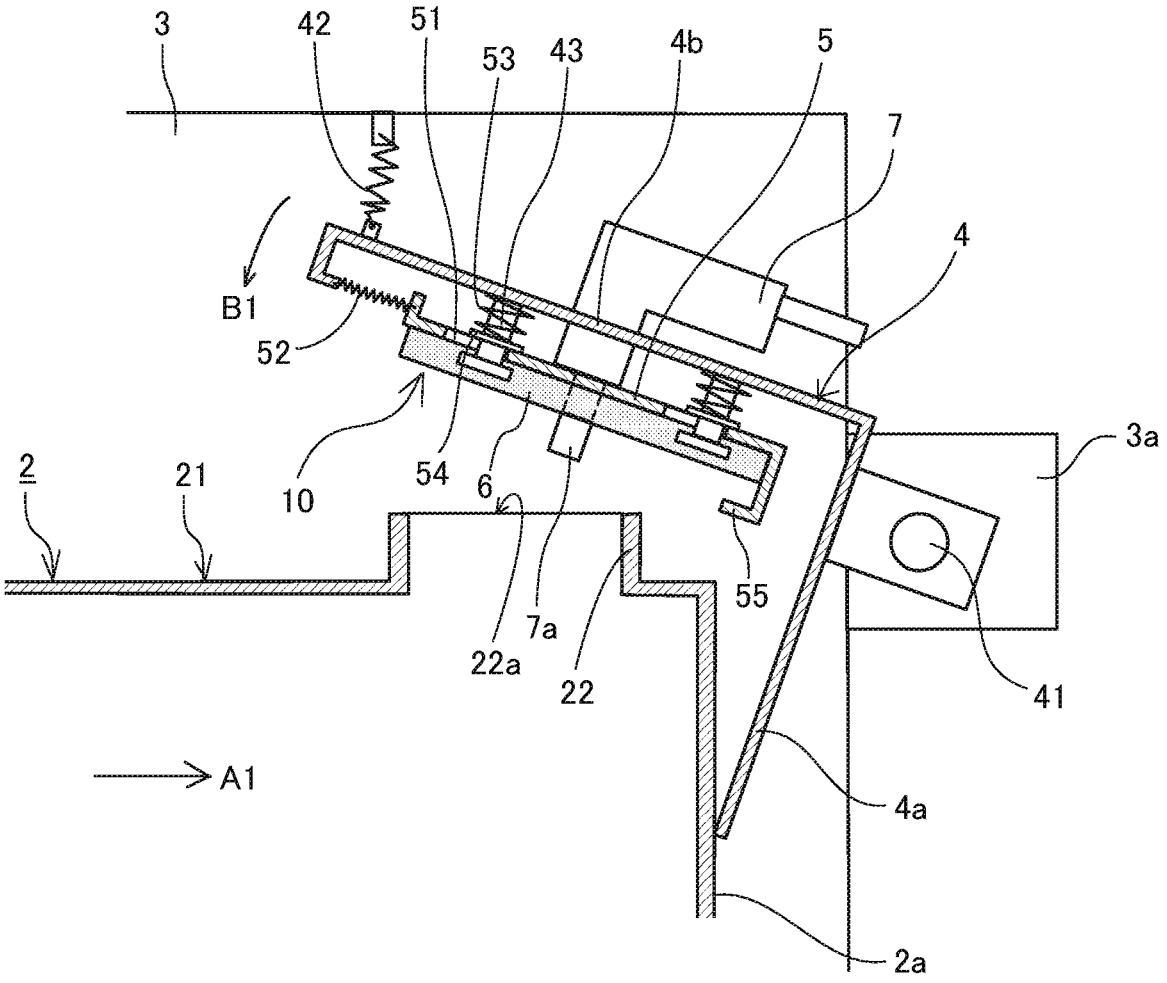
FIG. 2 is an enlarged side view of a main part when a rotatable member of the waste liquid collector is in a standby position.
Figure 3:
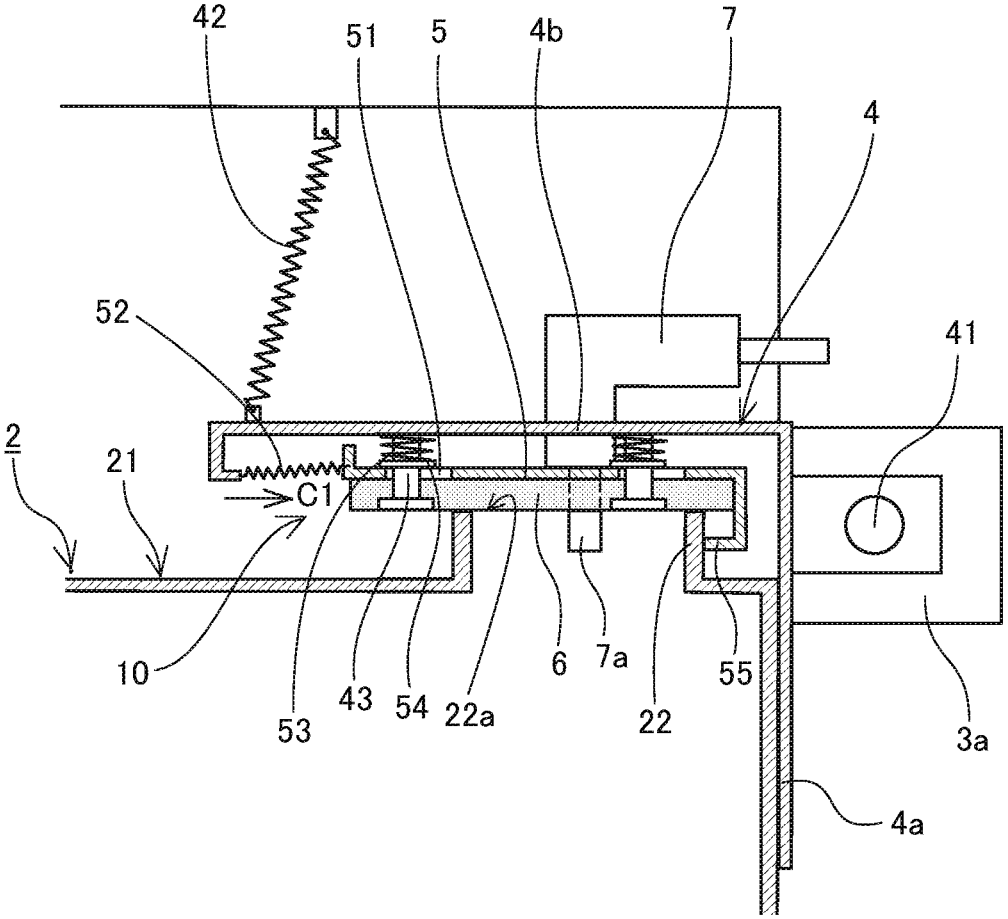
FIG. 3 is an enlarged side view of the main part when the rotatable member is in a linking position.
Figure 4:
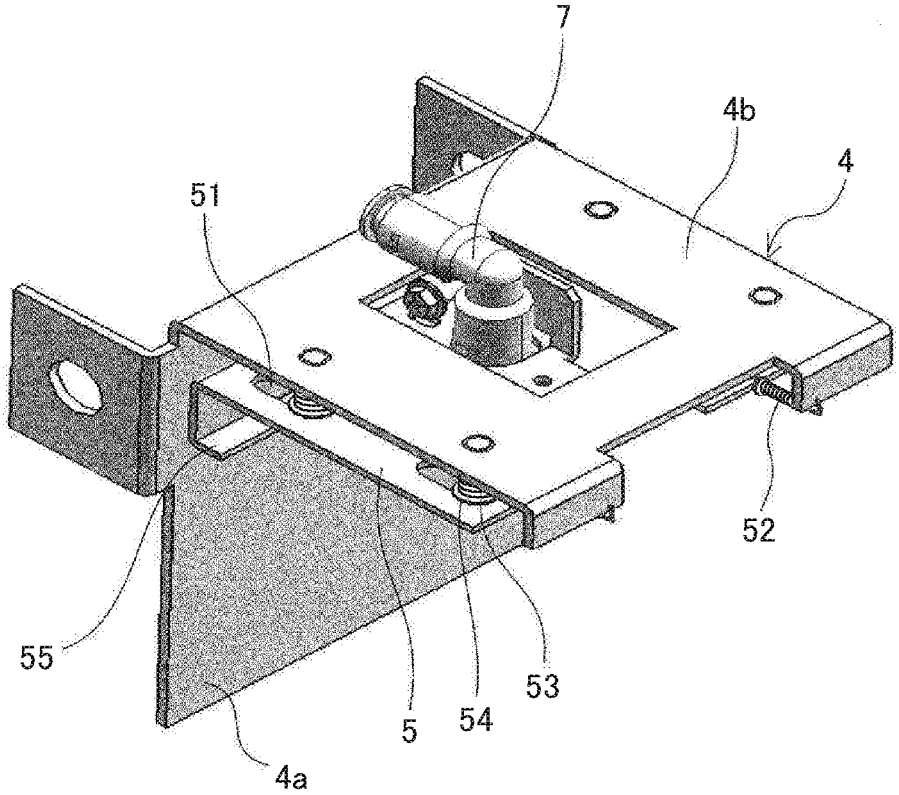
FIG. 4 is a perspective view of a part of the rotatable member viewed from above.
Figure 5:
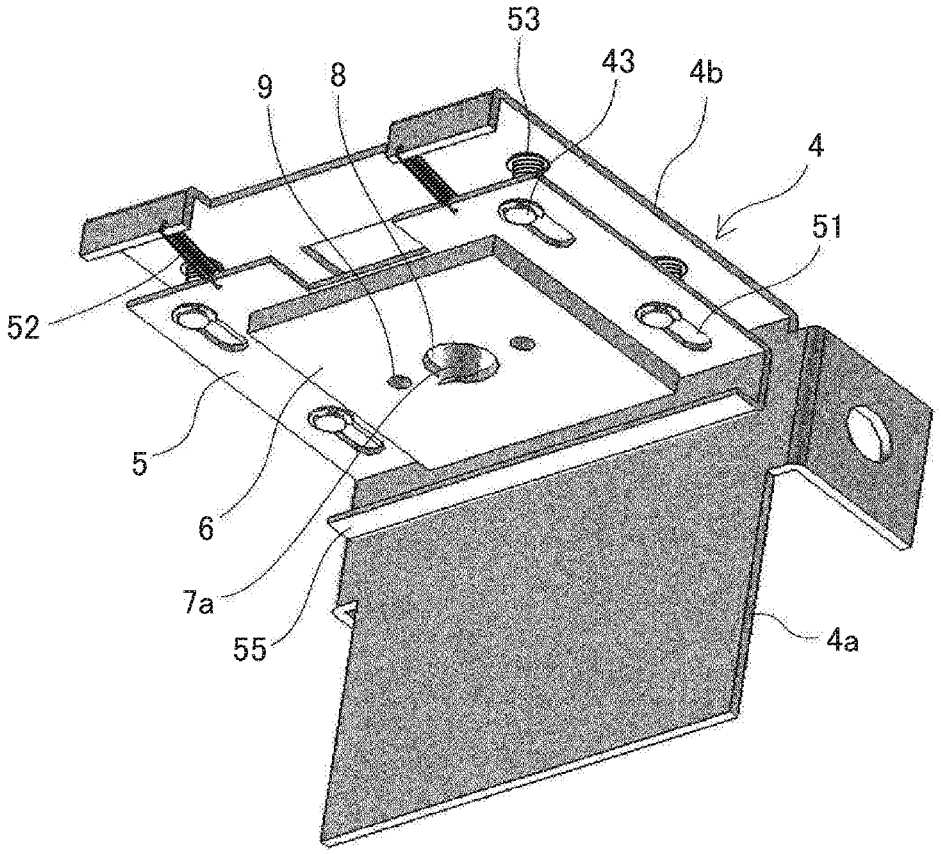
FIG. 5 is a perspective view of the part of the rotatable member viewed from below.

Hereinafter, an embodiment of the present disclosure will be described referring to the accompanying drawings. A first embodiment of the present disclosure will be described referring to FIGS. 1 to 5. FIG. 1 is a side view of a waste liquid collector according to the present embodiment. FIG. 2 is an enlarged side view of a main part when a rotatable member of the waste liquid collector is in a standby position. FIG. 3 is an enlarged side view of the main part when the rotatable member is in a linking position. FIG. 4 is a perspective view of a part of the rotatable member viewed from above. FIG. 5 is a perspective view of the part of the rotatable member viewed from below.

A waste liquid collector 1 has a waste liquid tank 2 serving as a waste liquid container that stores waste liquid, and a tank housing 3 into which the waste liquid tank 2 is removably inserted.

The waste liquid tank 2 has a tank body 21 that stores waste liquid, and a waste liquid inlet portion 22 projecting from the tank body 21 to form a waste liquid inlet 22*a*, the waste liquid inlet 22*a* being in communication inside the tank body 21.

The waste liquid tank 2 is removably inserted into the tank housing 3 in an arrow A direction. The insertion direction is defined as an arrow A1 direction and the removal direction is defined as an arrow A2 direction.

The tank housing 3 has a rotatable lever 4 including a rotatable member rotatably disposed on the back side (end side in the insertion direction) in the removal or insertion direction (arrow A direction) of the waste liquid tank 2. The rotatable lever 4 is rotatably supported by a supporting portion 3a of the tank housing 3 via a shaft 41, and rotatable between a standby position illustrated in FIGS. 1 and 2 and a linking position illustrated in FIG. 3. The linking position means a position where a waste liquid outlet portion 7*a* described later faces the waste liquid inlet 22*a* of the waste liquid tank 2 to be able to drain waste liquid.

The rotatable lever 4 includes a member formed by bending a tabular member. The rotatable lever 4 has an engaging portion 4*a* pressed by a front face 2*a* of the waste liquid tank 2 and a retaining portion 4*b* substantially orthogonal to the engaging portion 4*a*. The rotatable lever 4 is urged at the standby position illustrated in FIG. 2, with an urging member 42 such as a coil spring provided between an end opposite to the shaft 41 and the tank housing 3.

A cap 10 that seals the waste liquid inlet portion 22 of the waste liquid tank 2 is retained at the retaining portion 4*b* of the rotatable lever 4, movably (slidably) along the in-plane direction of the retaining portion 4*b* and movably forward and backward to the retaining portion 4*b*.

The cap 10 includes a cover 6 and a slider 5. The cover 6 contacts the waste liquid inlet portion 22 of the waste liquid tank 2 to cover the waste liquid inlet 22*a*. The slider 5 is slidable in the in-plane direction of the retaining portion 4*b* of the rotatable lever 4 and retains the cover 6 movably forward and backward to the retaining portion 4*b*.

Here, four guide shafts 43 provided at the retaining portion 4*b* of the rotatable lever 4 are movably fitted into respective guide slots 51 provided at the slider 5. Thus, the slider 5, together with the cover 6, is slidable and movable forward and backward to the retaining portion 4*b* of the rotatable lever 4.

The slider 5 is urged at the initial position illustrated in FIG. 2, by an urging member 52 such as a tension coil spring provided between the slider 5 and the leading end side of the rotatable lever 4. The urging member 52 urges the cover 6 in the upper left direction in the figure to retain the cover 6 at the initial position in FIG. 2, with the waste liquid tank 2 removed outside the waste liquid collector 1 from the tank housing 3. This arrangement allows the members to contact the waste liquid inlet portion 22 when the waste liquid tank 2 is inserted into the tank housing 3, in the order of a contact portion 55 of the slider 5 and the cover 6. This order enables reliably preventing friction of the waste liquid inlet portion 22 with the cover 6, in movement of the waste liquid inlet portion 22.

The slider 5 has the contact portion 55 that contacts the waste liquid inlet portion 22 of the waste liquid tank 2 to be pressed, when the waste liquid tank 2 is inserted in the insertion direction (arrow A1 direction).

An urging member 53 including, for example, a compression coil spring, fitted into each of the guide shafts 43, is disposed between the slider 5 and the retaining portion 4*b* of the rotatable lever 4. Thus, the slider 5, together with the cover 6, is movable forward and backward to the retaining portion 4*b*. As illustrated in FIG. 3, when the cover 6 contacts the waste liquid inlet portion 22 of the waste liquid tank 2, the urging members 53 each press the cover 6 on the waste liquid inlet portion 22 side, due to urging force (recovery force).

The urging members 53 that each press (urge) the cover 6 on the waste liquid inlet portion 22 side are respectively received at retaining members 54 each serving as an urging member supporting member on the slider 5 side. With this arrangement, the respective ends on the slider 5 side of the urging members 53 are relatively movable to the slider 5 to prevent the urging members 53 from twisting.

The slider 5 retains a waste liquid outlet member 7 having a waste liquid outlet portion 7*a* that drains waste liquid, the waste liquid outlet portion 7*a* penetrating through a through hole 8 of the cover 6.

The waste liquid outlet member 7 penetrates through the rotatable lever 4 so as to be movable with the movement of the slider 5.

The cover 6 is provided with an air hole 9.

As the cover 6, a member such as Mylar (registered trademark) having high smoothness and a low coefficient of friction is desirable; however, the cover 6 is not limited such a member. Furthermore, the cover 6 may contact the entirety of the upper end portion of the waste liquid inlet portion 22 to seal the waste liquid inlet 22*a*, or may have a predetermined space between the cover 6 and the upper end portion of the waste liquid inlet portion 22 and contact the upper end portion of the waste liquid inlet portion 22 to cover the waste liquid inlet 22*a*.

Meanwhile, as illustrated in FIG. 1, the waste liquid collector 1 has an open/close door 31 on the front side in the insertion direction (arrow A1 direction) of the waste liquid tank 2. The open/close door 31 is rotatable around a rotation shaft 32 and has a projection 33 provided inside the open/close door 31 pressurize the waste liquid tank 2 toward the back side in the insertion direction. The projection 33 regulates that the waste liquid tank 2 is pushed back to the front side in the insertion direction due to the urging force of the urging members 42 and 52 of the rotatable lever 4, after insertion of the waste liquid tank 2 into the waste liquid collector 1 is completed.

Figure 6:
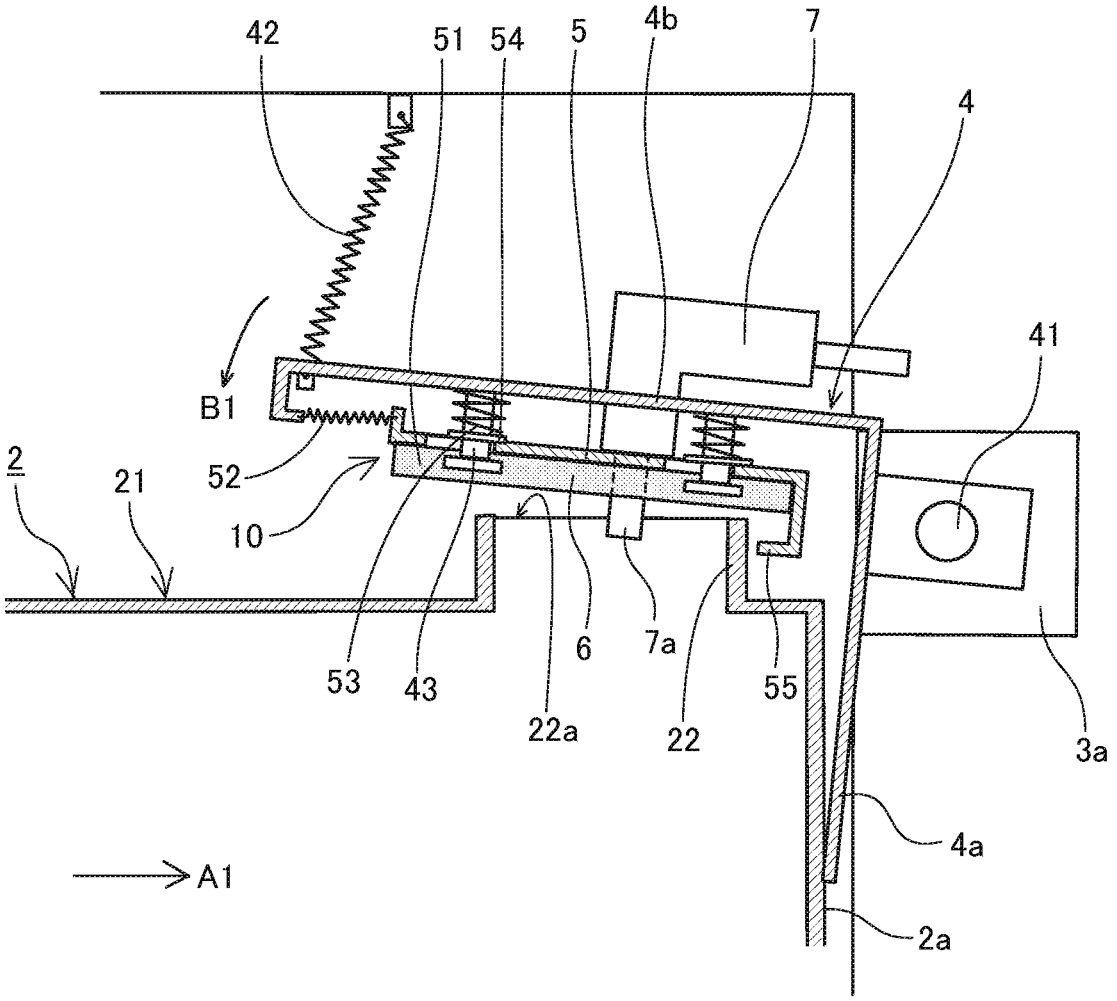
FIG. 6 is a side view of a part of a rotatable lever in the insertion process of a waste liquid tank for describing an operation of the first embodiment.
Figure 7:
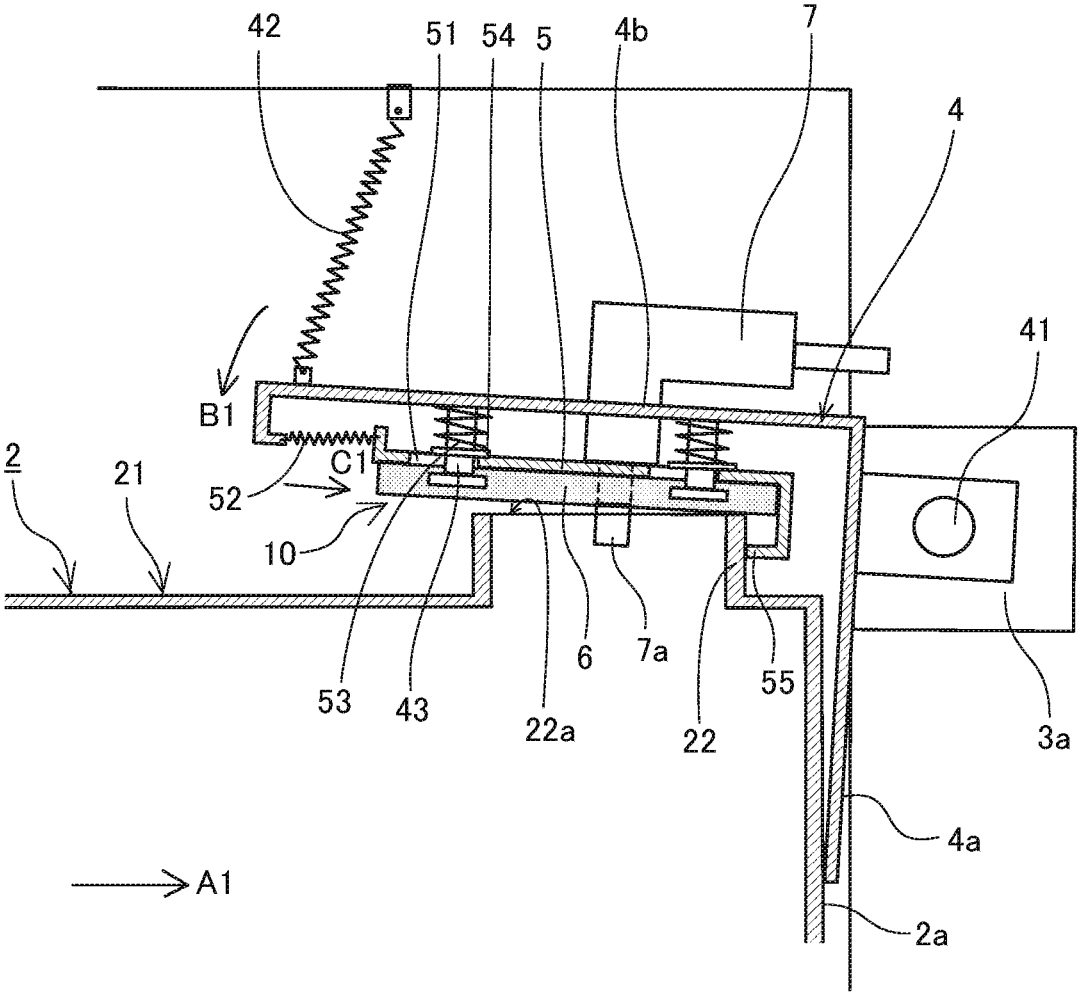
FIG. 7 is a side view of the part of the rotatable lever in the insertion process of the waste liquid tank for also describing the operation of the first embodiment.

Next, the operation of the present embodiment will be described referring to FIGS. 6 and 7. FIGS. 6 and 7 are explanatory side views of a part of the rotatable lever in the insertion process of the waste liquid tank provided to the operation description of the present embodiment.

When the waste liquid tank 2 is housed into the tank housing 3, the waste liquid tank 2 is inserted in the arrow A1 direction in FIG. 1, and as illustrated in FIGS. 1 and 2, the front face 2*a* of the waste liquid tank 2 contacts the engaging portion 4*a* of the rotatable lever 4.

When the waste liquid tank 2 is pushed further in the arrow A1 direction from this state, as illustrated in FIG. 6, the engaging portion 4*a* of the rotatable lever 4 is pressed by the waste liquid tank 2. The rotatable lever 4 then resists the recovery force of the urging member 42 to rotate in arrow B1 direction.

Then, when the waste liquid tank 2 is pushed further in the arrow A1 direction, as illustrated in FIG. 7, the waste liquid inlet portion 22 of the waste liquid tank 2 contacts the contact portion 55 of the slider 5 included in the cap 10.

When the waste liquid tank 2 is pushed further in the arrow A1 direction from this state, the rotatable lever 4 further rotates in arrow B1 direction. Together with the further rotating of the rotatable lever 4, the slider 5 is pushed by the waste liquid inlet portion 22. As a result, the slider 5 moves (slides) together with the cover 6 in an arrow C1 direction.

At this time, although the cover 6 comes in to contact with the waste liquid inlet portion 22 of the waste liquid tank 2, and the slider 5 slides to the rotatable lever 4. Therefore, when the waste liquid tank 2 is pushed in the arrow A1 direction, the rotatable lever 4 is rotatable in the arrow B1 direction, with the relative position between the cover 6 and the waste liquid inlet portion 22 of the waste liquid tank 2 substantially maintained.

Then, when the waste liquid tank 2 is pushed further in the arrow A1 direction, as illustrated in FIG. 3, the rotatable lever 4 further rotates in the arrow B1 direction, and the cover 6 is pressed against the waste liquid inlet portion 22 of the waste liquid tank 2. As a result, the waste liquid inlet portion 22 is sealed (capped) with the cover 6.

As described above, when the waste liquid inlet portion 22 of the waste liquid tank 2 is sealed with the cover 6, the cover 6 is slidable to the rotatable lever 4 including the rotatable member. Thus, this arrangement enables reducing friction of the cover 6 with the waste liquid inlet portion 22. As a result, damage to the cover 6 with time can be reduced.

Furthermore, the waste liquid outlet portion 7*a* is located in the waste liquid tank 2 with the waste liquid inlet portion 22 of the waste liquid tank 2 sealed with the cover 6. Thus, the waste liquid outlet portion 7*a* is no longer exposed to the external environment.

With this arrangement, when waste liquid of easily dried liquid such as high viscosity liquid is collected, even in a case where residual waste liquid is produced without dropping into the waste liquid tank 2 from the waste liquid outlet portion 7*a*, the residual waste liquid is inhibited drying. Thus, clogging of the waste liquid outlet portion 7*a* is inhibited.

Figure 8:
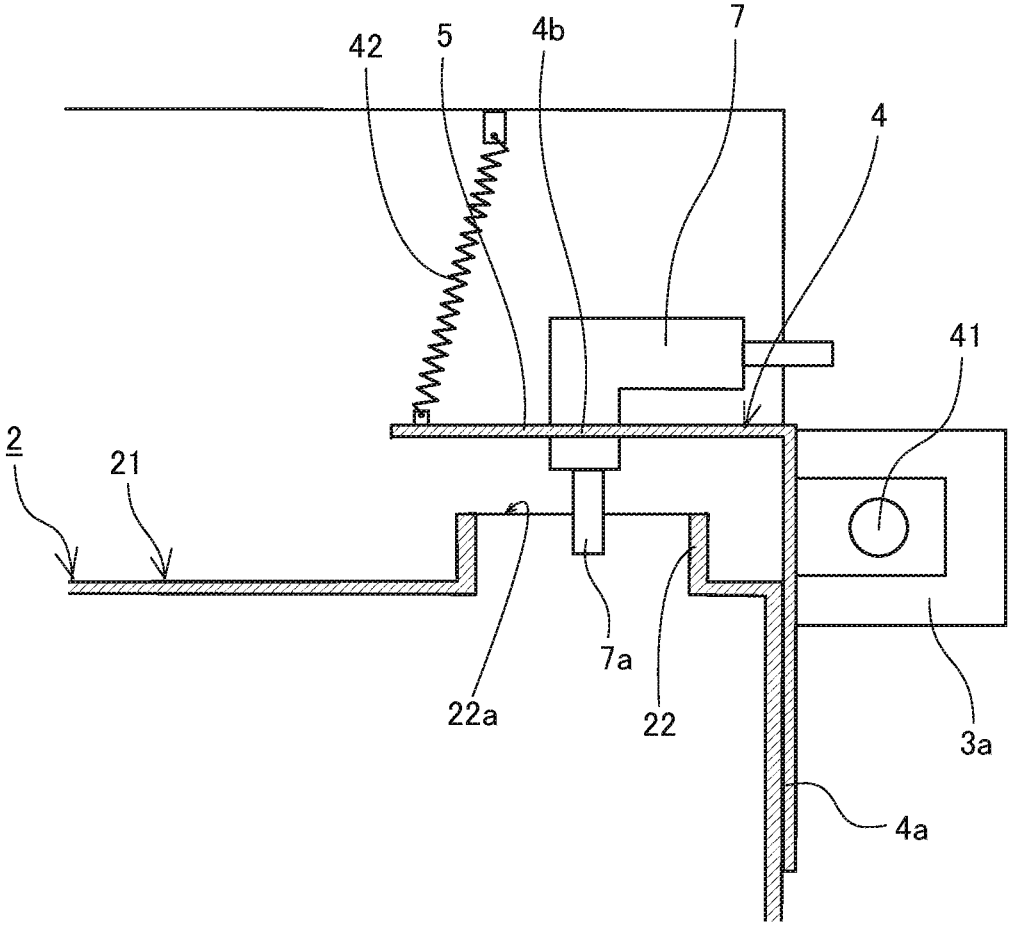
FIG. 8 is a side view provided for describing a waste liquid collector according to Comparative Example 1.

Next, Comparative Example 1 will be described referring to FIG. 8. FIG. 8 is a side view provided for describing a waste liquid collector according to Comparative Example 1.

For Comparative Example 1, a rotatable lever 4 is not provided with the cap 10 of the first embodiment, and a waste liquid outlet member 7 is retained.

For Comparative Example 1, the inside of a waste liquid tank 2 is open to the external environment, and a waste liquid outlet portion 7*a* is exposed to the external environment. Thus, in use of easily dried liquid such as high viscosity liquid, residual waste liquid in the waste liquid outlet portion 7*a* is dried and adheres, and the waste liquid outlet portion 7*a* is clogged with the solidified waste liquid. As a result, the clogging causes an inconvenience that waste liquid is uncollectible.

Figure 9:
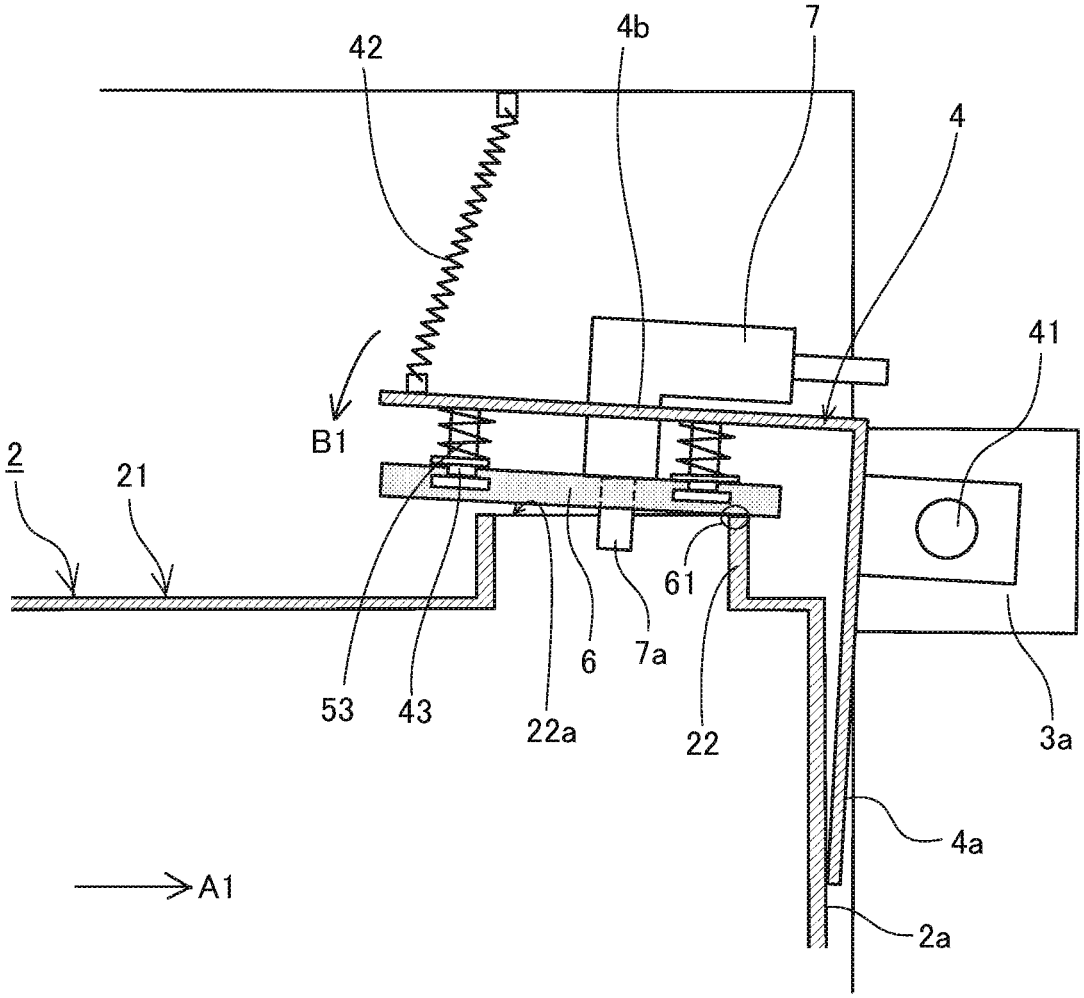
FIG. 9 is a side view provided for describing a part of a rotatable member of a waste liquid collector according to Comparative Example 2.
Figure 10:
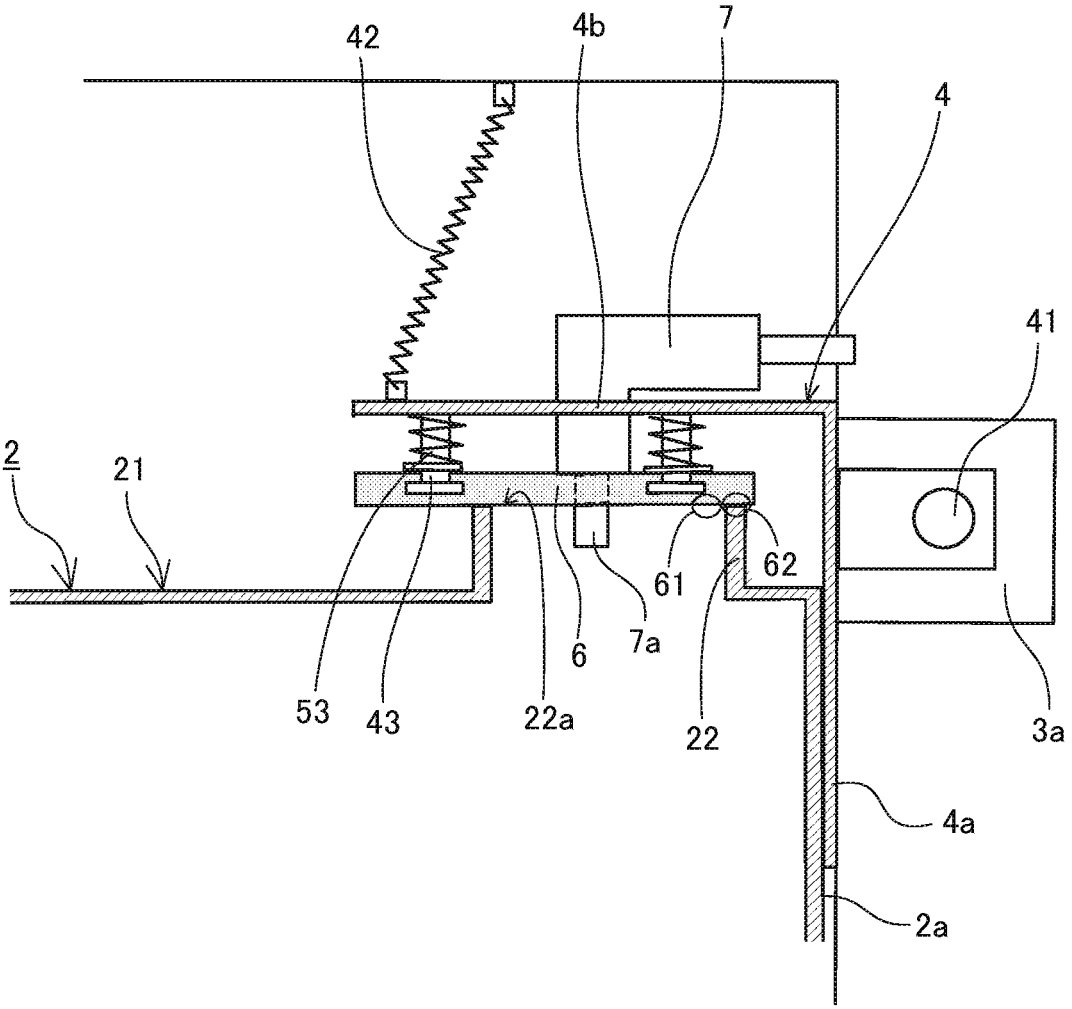
FIG. 10 is a side view of the part of the rotatable member provided for describing an operation of Comparative Example 2.

Next, Comparative Example 2 will be described referring to FIGS. 9 and 10. FIG. 9 is a side view provided for describing a part of a rotatable member of a waste liquid collector according to Comparative Example 2. FIG. 10 is a side view of the part of the rotatable member of the waste liquid collector provided for describing the operation description of Comparative Example 2.

For Comparative Example 2, a cover 6 is retained non-slidably to a rotatable lever 4.

For Comparative example 2, as illustrated in FIG. 9, when a waste liquid tank 2 is pushed in the arrow A1 direction, the rotatable lever 4 rotates and an initial contact position 61 of the cover 6 contacts a waste liquid inlet portion 22 of the waste liquid tank 2.

When the waste liquid tank 2 is pushed further in the arrow A1 direction from this state, the cover 6 is non-slidable to the rotatable lever 4. Thus, when the rotatable lever 4 further rotates in the arrow B1 direction, the cover 6 causes friction with the waste liquid inlet portion 22 and moves relatively. Then, as illustrated in FIG. 10, sealing is completed with a final contact position 62 of the cover 6 contacting the waste liquid inlet portion 22.

As described above, together with removal or insertion of the waste liquid tank 2, the cover 6 causes friction with the waste liquid inlet portion 22. As a result, there may arise a defect that the cover 6 is deteriorated and damaged with time.

Figure 11:
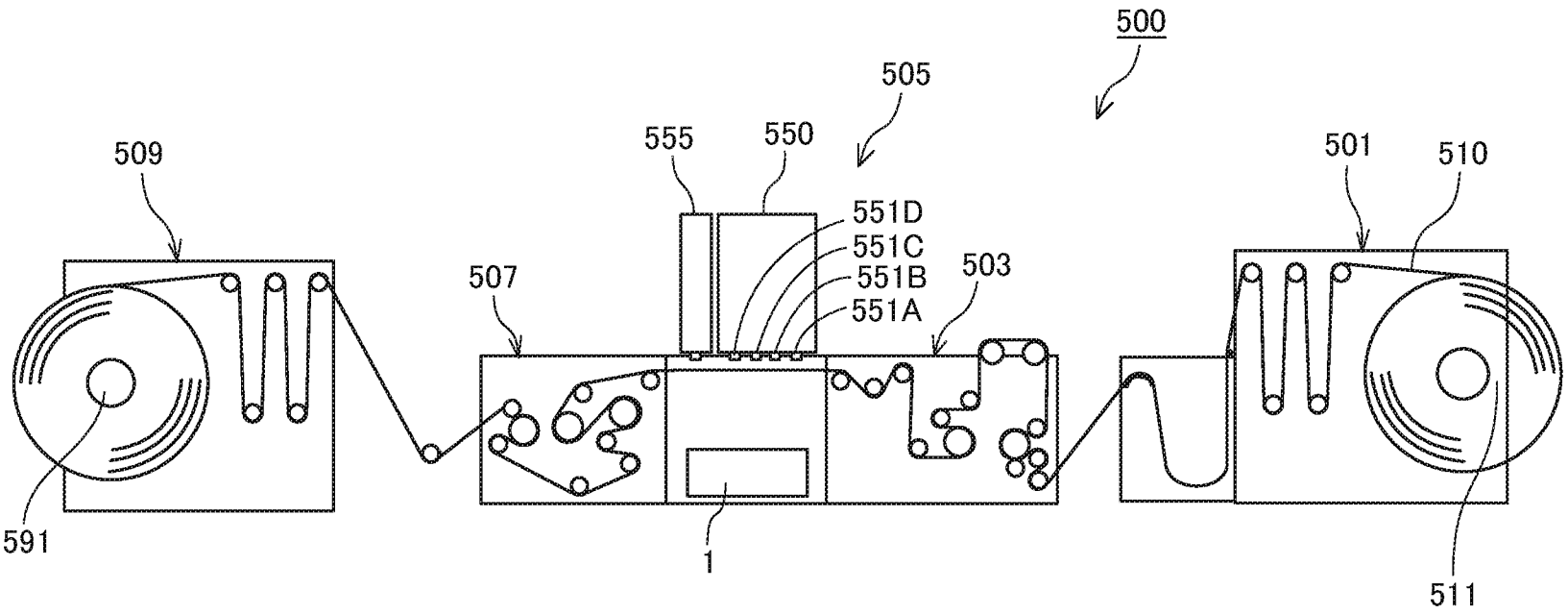
FIG. 11 is a schematic view of an example of a liquid discharge apparatus according to an embodiment of the present disclosure.
Figure 12:
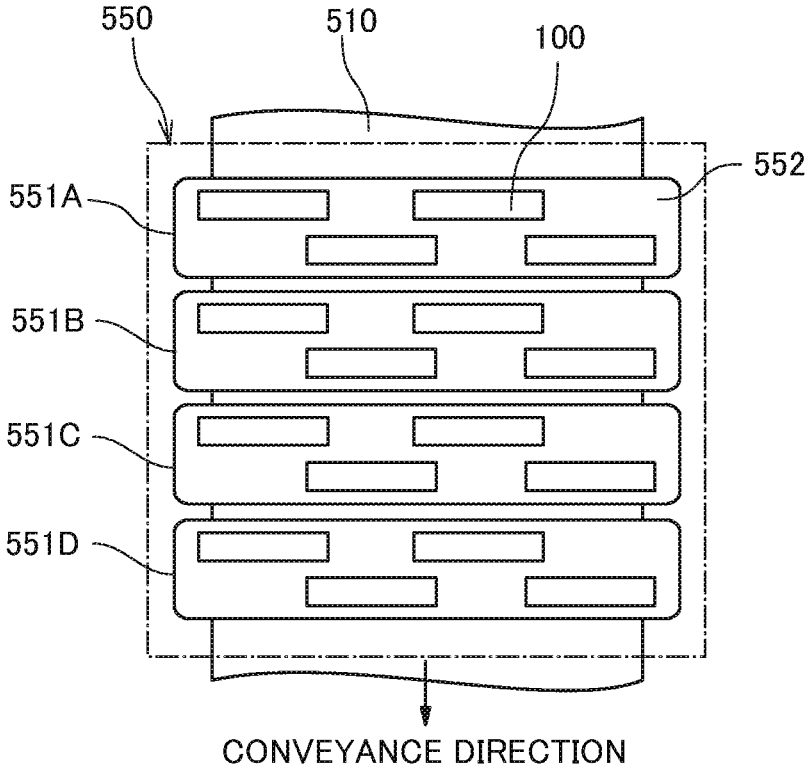
FIG. 12 is a plan view of an exemplary head unit of the liquid discharge apparatus of FIG. 11.

Next, a liquid discharge apparatus according to an embodiment of the present disclosure is described referring to FIGS. 11 and 12. FIG. 11 is a schematic view of the liquid discharge apparatus. FIG. 12 is a plan view of an example of a head unit of the liquid discharge apparatus.

A printing apparatus 500 serving as the liquid discharge apparatus includes: a feed-in device 501; a guiding and conveying device 503; a printing device 505; a drying device 507; a feed-out device 509; and the like. The feed-in device 501 feeds a continuous body 510 inward. The guiding and conveying device 503 guides and conveys the continuous body 510 fed inward from the feed-in device 501. The printing device 505 performs printing by discharging liquid onto the conveyed continuous body 510 to form an image. The drying device 507 dries the continuous body 510 with the image formed. The feed-out device 509 feeds the dried continuous body 510 outward.

The continuous body 510 is sent from an unwinding roller 511 of the feed-in device 501, and guided and conveyed by each of rollers of the feed-in device 501, the guiding and conveying device 503, the drying device 507, and the feed-out device 509. Then, the continuous body 510 guided and conveyed is wound by a winding roller 591 of the feed-out device 509.

The continuous body 510 is conveyed by the printing device 505 so as to face a head unit 550 and a head unit 555. An image is formed on the conveyed continuous body 510 with liquid discharged from the head unit 550. Then, the continuous body 510 with the image formed is subjected to post-treatment with treatment liquid discharged from the head unit 555.

Here, the head unit 550 has, for example, full-line head arrays 551A, 551B, 551C, and 551D for four colors (hereinafter referred to as "head array 551" when difference in color is unconsidered) disposed at the head unit 550 in the above order from the upstream side in the conveying direction.

The head arrays 551 each serve as a liquid discharge section, and discharge liquid of black K, cyan C, magenta M, and yellow Y onto the conveyed continuous body 510, respectively. The type and number of colors are not limited to the above case.

The head arrays 551 each have, for example, liquid discharge heads (also referred to simply as "heads") 100 staggered on a base member 552; however, the disposition is not limited to this case.

The printing device 505 has the waste liquid collector 1 according to the present disclosure provided in the printing device 505.

This arrangement allows the waste liquid collector 1 to collect waste liquid over a long period of time, without occurrence of clogging of the waste liquid outlet portion 7*a*.

In this case, examples of waste liquid that can be collected by the waste liquid collector 1 include waste liquid of an ink and a treatment agent produced due to dummy discharge (including flushing and purging) in which waste liquid noncontributory to printing is discharged, as maintenance of a liquid discharge head.

Note that the printing apparatus 500 may not be an apparatus that performs printing on a continuous body, but may be an apparatus that performs printing on a flat sheet, that is, a cut sheet.

In addition, in the terms of the present application, image formation, recording, printing characters, printing graphics, printing, modeling, and the like are all synonymous.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A waste liquid collector comprising:

a waste liquid tank removably inserted in the waste liquid collector, the waste liquid tank configured to collect waste liquid;

a rotatable member configured to rotate with removal or insertion of the waste liquid tank; and a cover configured to contact a waste liquid inlet portion of the waste liquid tank to cover the waste liquid inlet portion, the cover being slidable with respect to the rotatable member.

2. The waste liquid collector according to claim 1, further comprising a slider slidably retained with respect to the rotatable member, wherein the cover is retained on the slider.

3. The waste liquid collector according to claim 2, wherein the slider is configured to be moved by pressing of the waste liquid inlet portion of the waste liquid tank.

4. The waste liquid collector according to claim 2, further comprising an urging member disposed between the slider and the rotatable member and configured to urge the cover toward the waste liquid inlet portion of the waste liquid tank, wherein the slider is retained to be movable forward and backward with respect to the rotatable member.

5. The waste liquid collector according to claim 4, further comprising:

a guide slot in the slider;

a guide shaft retained on the rotatable member and being relatively movable with respect to the guide slot; and a supporting member disposed between the guide slot and the urging member, the supporting member supporting the urging member.

6. The waste liquid collector according to claim 1, further comprising a waste liquid outlet portion penetrating through the cover, the waste liquid outlet portion configured to drain the waste liquid into the waste liquid tank.

7. A liquid discharge apparatus comprising the waste liquid collector according to claim 1.

* * * * *